US008191231B2

(12) United States Patent
Lo et al.

(10) Patent No.: US 8,191,231 B2
(45) Date of Patent: Jun. 5, 2012

(54) METHOD FOR MANUFACTURING ANTENNA

(75) Inventors: Wen-Kuei Lo, Hsinchu (TW); Sheng-Chieh Chang, Hsinchu (TW); Bau-Yi Huang, Hsinchu (TW); Chi-Wen Tsai, Hsinchu (TW); Hsin-Hui Hsu, Hsinchu (TW); Tzuh-Suan Wang, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 8 days.

(21) Appl. No.: 12/972,873

(22) Filed: Dec. 20, 2010

(65) Prior Publication Data

US 2012/0042505 A1 Feb. 23, 2012

(30) Foreign Application Priority Data

Aug. 20, 2010 (TW) ..... 99127965 A

(51) Int. Cl.
*H01P 11/00* (2006.01)

(52) U.S. Cl. ..... 29/600; 427/555; 343/700 MS

(58) Field of Classification Search ..... 29/592.1, 29/600, 830–831, 846–852; 343/700 MS, 343/876; 427/555; 455/575.1, 575.5; 216/13, 216/62, 66, 75; 340/572.1–572.4
See application file for complete search history.

(56) References Cited

U.S. PATENT DOCUMENTS

| | | | | |
|---|---|---|---|---|
| 4,322,457 | A * | 3/1982 | Baron et al. | 205/126 |
| 5,786,910 | A * | 7/1998 | Walters et al. | 359/2 |
| 6,421,011 | B1 * | 7/2002 | Van Egmond et al. | 343/700 MS |
| 6,471,878 | B1 * | 10/2002 | Greene et al. | 216/13 |
| 7,087,267 | B2 * | 8/2006 | Breen et al. | 427/304 |
| 7,421,775 | B2 * | 9/2008 | Kwak et al. | 29/600 |
| 2006/0281500 | A1 * | 12/2006 | Huang et al. | 455/575.1 |
| 2010/0009094 | A1 * | 1/2010 | Lochtman et al. | 427/555 |
| 2012/0017427 | A1 * | 1/2012 | Lo et al. | 29/600 |

* cited by examiner

*Primary Examiner* — Minh Trinh
(74) *Attorney, Agent, or Firm* — CKC & Partners Co., Ltd.

(57) ABSTRACT

A method for manufacturing an antenna includes steps as follows. First, a substrate is provided, wherein a surface of the substrate has an antenna region. Then, the surface of the substrate is electroless plated with a metal medium, so that the surface is covered with the metal medium. Then, the metal medium is covered with a resist. Then, a portion of the resist in the antenna region is removed. Then, the antenna region is electroplated with metal material to form an antenna main body. Then, a remaining portion of the resist is removed, and excluding a portion of the metal medium in the antenna region, the other portion of the metal medium is also removed from the substrate.

9 Claims, 5 Drawing Sheets

METHOD FOR MANUFACTURING ANTENNA

RELATED APPLICATIONS

This application claims priority to Taiwan Application Serial Number 099127965, filed Aug. 20, 2010, which is herein incorporated by reference.

BACKGROUND

1. Technical Field

The present disclosure relates to manufacturing methods, and more particularly, a method for manufacturing an antenna.

2. Description of Related Art

With the fast development of the electronics industry and information technology, the application of information products has become more popular. For example, mobile phones, e-book readers and laptops are commonly used devices. Accordingly, manufacturers conscientiously work to find every possible means for manufacturing antennas of wireless communication.

Because a solid sheet metal antenna has larger volume, in a conventional device a housing needs reserved space for configuring the solid sheet metal antenna. On the other hand, the height of the solid sheet metal antenna is restricted by the reserved space. Therefore, it's very difficult to reduce the size of the device, but the current trend is towards small device size. Moreover, this antenna cannot achieve optimum radiation pattern and signal reception.

SUMMARY

The following presents a simplified summary of the disclosure in order to provide a basic understanding to the reader. This summary is not an extensive overview of the disclosure and it does not identify key/critical elements of the present invention or delineate the scope of the present invention. Its sole purpose is to present some concepts disclosed herein in a simplified form as a prelude to the more detailed description that is presented later.

In one aspect, the present disclosure is directed to a method for manufacturing an antenna. The method is performed to form the antenna on a housing of a product through both electroless plating and electroplating, so that the inner space of the housing can be effectively reduced.

The method includes steps as follows. First, a substrate is provided, wherein a surface of the substrate has an antenna region. Then, the surface of the substrate is electroless plated with a metal medium, so that the surface is covered with the metal medium. Then, the metal medium is covered with a resist. Then, a portion of the resist in the antenna region is removed. Then, the antenna region is electroplated with metal material to form an antenna main body. Then, a remaining portion of the resist is removed, and excluding a portion of the metal medium in the antenna region, the other portion of the metal medium is also removed from the substrate.

According to one embodiment, the antenna region has antenna pattern.

According to one embodiment, the surface of the substrate is roughened.

According to one embodiment, a recess is formed in the antenna region.

According to one embodiment, the material of the metal medium is palladium or polymeric material.

According to one embodiment, the portion of the resist in the antenna region is removed to expose the portion of the metal medium to the antenna region.

According to one embodiment, the remaining portion of the resist is removed through dry etching.

According to one embodiment, the dry etching is laser carving.

According to one embodiment, the metal material is copper, nickel or gold.

Technical advantages are generally achieved, by the method of the present invention. The method is performed to form the antenna on a housing of a communication product through both of electroless plating and electroplating, so that the inner space of the housing can be effectively reduced. In use, the antenna of the present invention can replace the conventional sheet metal antenna, so as to simplify production process and to save assembly time.

Many of the attendant features will be more readily appreciated, as the same becomes better understood by reference to the following detailed description considered in connection with the accompanying drawings.

BRIEF DESCRIPTION OF THE DRAWINGS

The present description will be better understood from the following detailed description read in light of the accompanying drawings, wherein.

DETAILED DESCRIPTION

Figure 1:
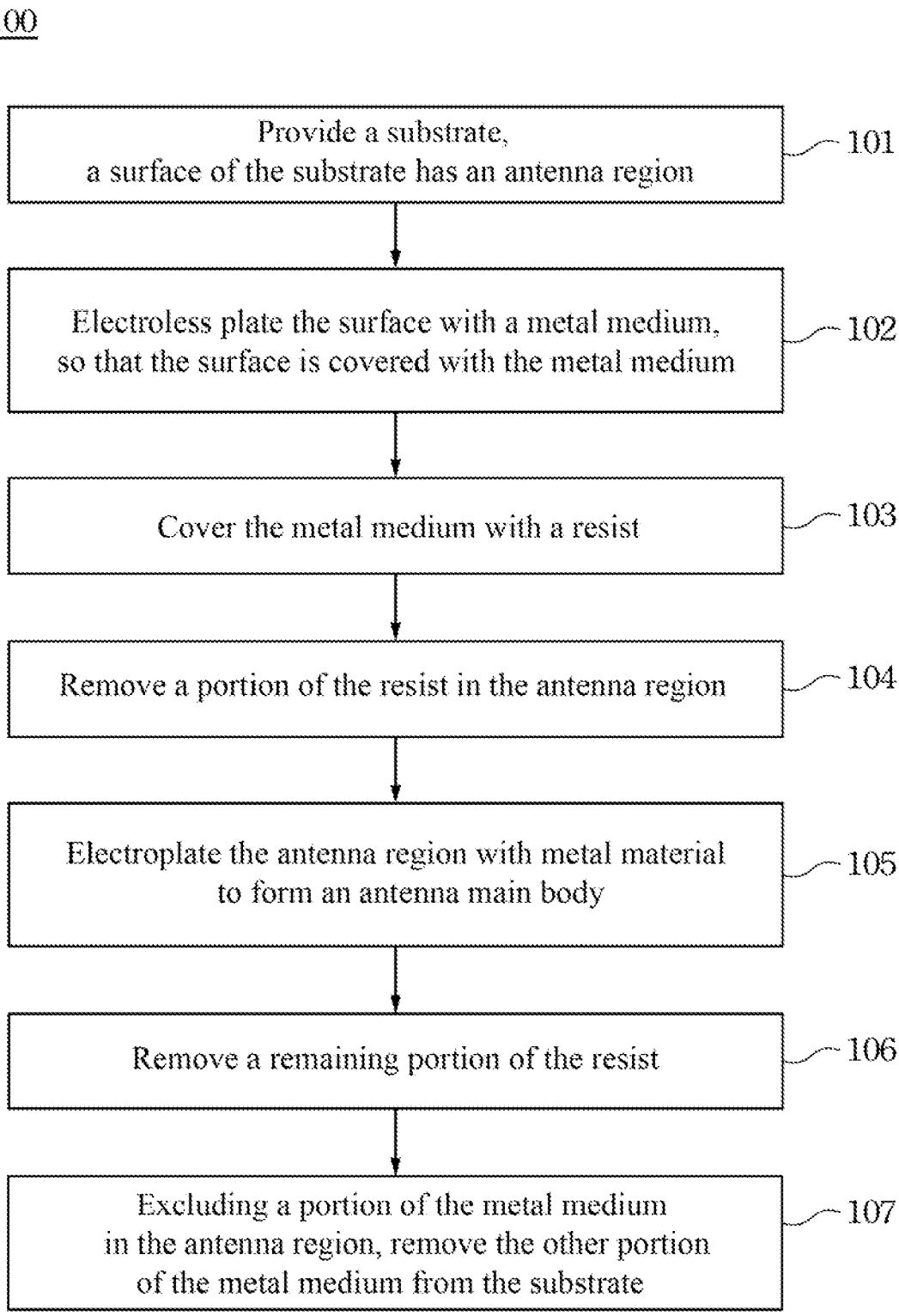
FIG. 1 is a flowchart of a manufacturing method according to one embodiment of the present disclosure.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Refer to FIG. 1 and FIGS. 2A to 2G. FIG. 1 is a flowchart of a method 100 for manufacturing an antenna according to one embodiment of the present disclosure. FIGS. 2A to 2G illustrate the steps of the manufacturing method of FIG. 1.

As shown in FIG. 1, the method 100 includes the steps as follows (The steps are not recited in the sequence in which the steps are performed. That is, unless the sequence of the steps is expressly indicated, the sequence of the steps is interchangeable, and all or part of the steps may be simultaneously, partially simultaneously, or sequentially performed). First, a substrate 210 is provided in step 101, wherein a surface 212 of the substrate 210 has an antenna region 214. Then, the surface 212 of the substrate 210 is electroless plated with a metal medium 220 in step 102, so that the surface 212 is covered with the metal medium 220. Then, the metal medium 220 is covered with a resist 230 in step 103. Then, a portion of the resist 230 in the antenna region 214 is removed in step 104. Then, the antenna region 214 is electroplated with metal material to form an antenna main body 240 in step 105. Then, a remaining portion of the resist 230 is removed, and excluding a portion of the metal medium 220 within the antenna region 140, the other portion of the metal medium 220 is also removed from the substrate 210.

Figure 2A:
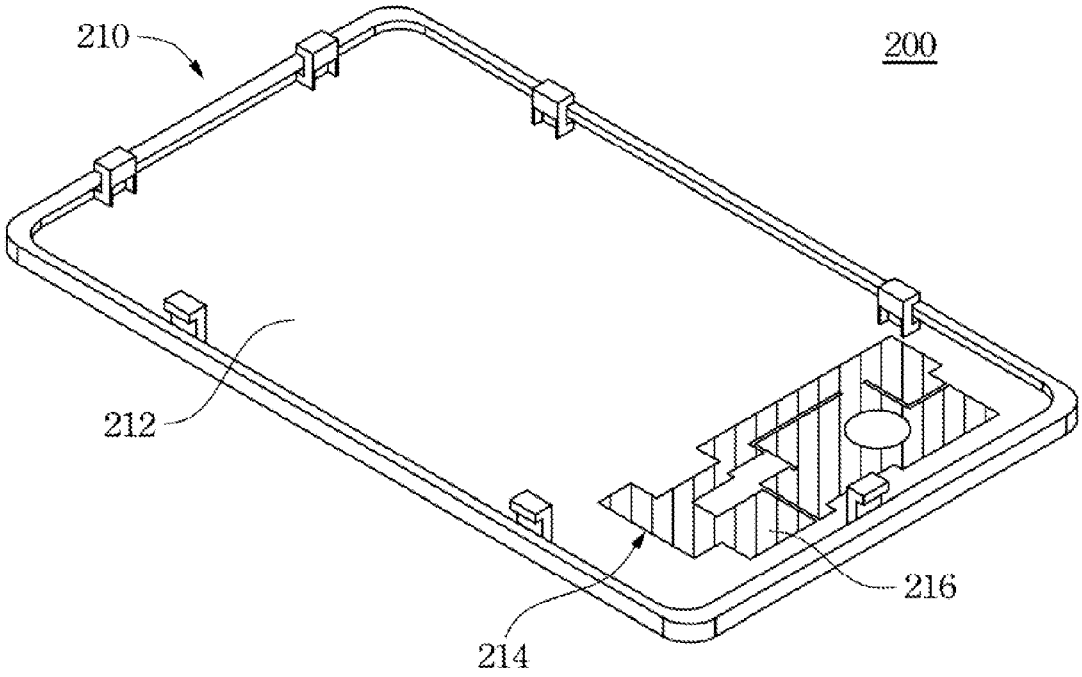
FIGS. 2A to 2G illustrate the steps of the manufacturing method of FIG. 1.

In the method 100, step 101 is to provide the substrate 210 of an antenna device 200 as shown in FIG. 2A. The substrate 210 may be a housing of a wireless communication product, where the communication product may be a mobile phone, an e-book reader, a laptop or the like. And the material of the substrate 210 is plastic material or another nonconductor. In one embodiment, the surface 212 of the substrate 210 is roughened. For example, the substrate 210 is soaked in a strong acid solution or a strong base solution, so the surface 212 of the substrate 210 can be roughened; alternatively, laser carving is implemented on the antenna region 214, so that the partial surface of the substrate 210 can be roughened.

Moreover, the antenna region 214 has an antenna pattern. In one embodiment, the laser carving is implemented to form a recess 216 corresponding to the antenna pattern in the antenna region 214. Thus, the surface friction coefficient of the substrate 210 can be improved to further the fitness of the metal medium 220 as shown in FIG. 2B.

Figure 2B:
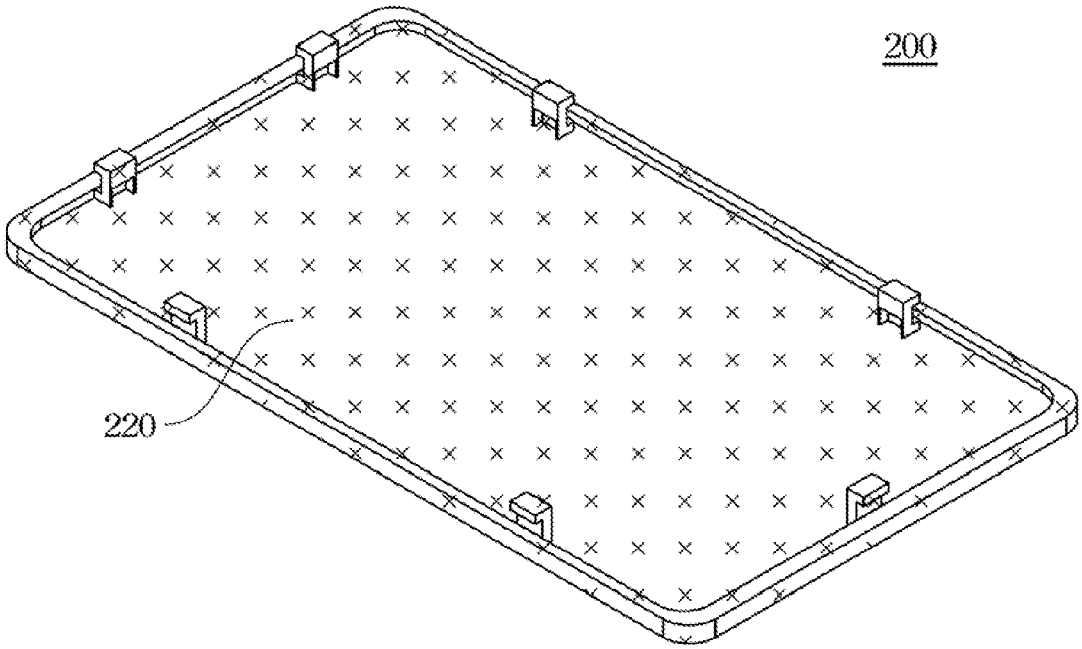

In the method 100, step 102 is to electroless plate the substrate 210 with the metal medium 220, so that the surface 212 of the substrate 210 can be covered with the metal medium 220 as shown in FIG. 2B. In one embodiment, the material of the metal medium is palladium or polymeric material. It should be appreciated that the metal medium 220 formed on the entire surface 212 illustrated in FIG. 2B are only examples and should not be regarded as limitations of the present invention. In another embodiment, the metal medium may be formed on a partial surface of the substrate.

Figure 2C:
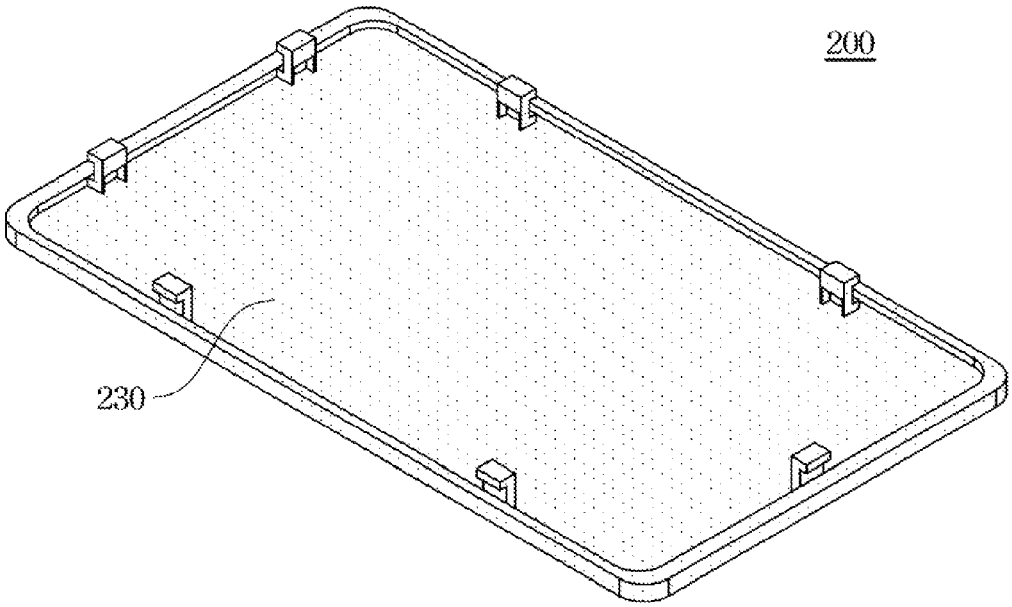

In the method 100, step 103 is to form a resist 230 on the metal medium 210, so that the metal medium 210 is covered with the resist 230 as shown in FIG. 2C. The surface 212 of substrate 210 is coated with resist 230, so as to prevent acidic or basic materials from eroding the surface 212.

Figure 2D:
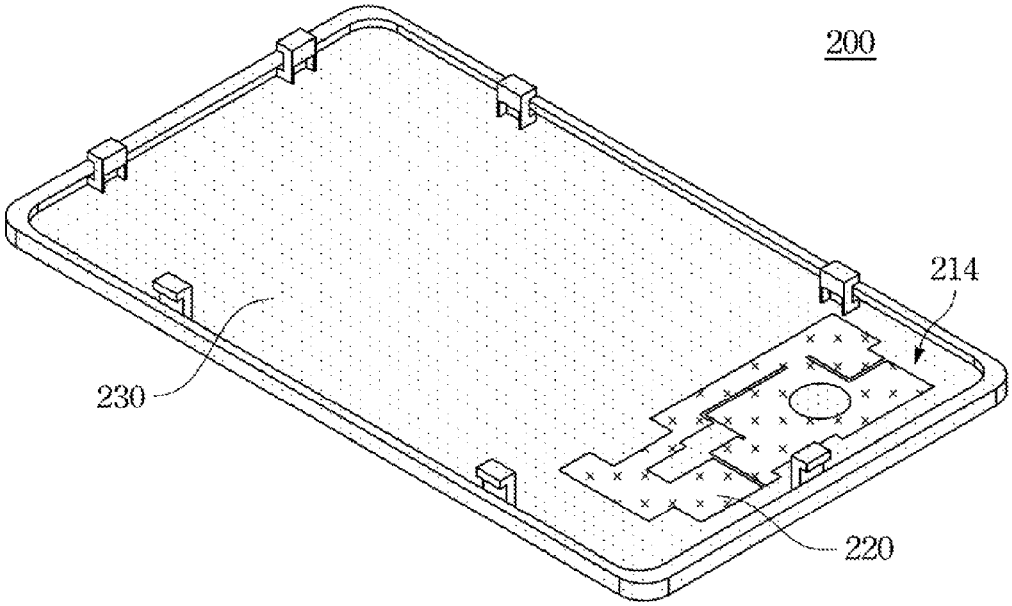

In the method 100, step 104 is to remove a portion of the resist 230 in the antenna region 214, so that a portion of the metal medium 220, corresponding to the antenna pattern, is exposed to the antenna region 214, as shown in the antenna device 200 of FIG. 2D. In one embodiment, the portion of the resist 230 in the antenna region 214 is removed through dry etching. For example, the dry etching is laser carving, so as to improve the precision of the antenna pattern exposed in the antenna region 214.

Figure 2E:
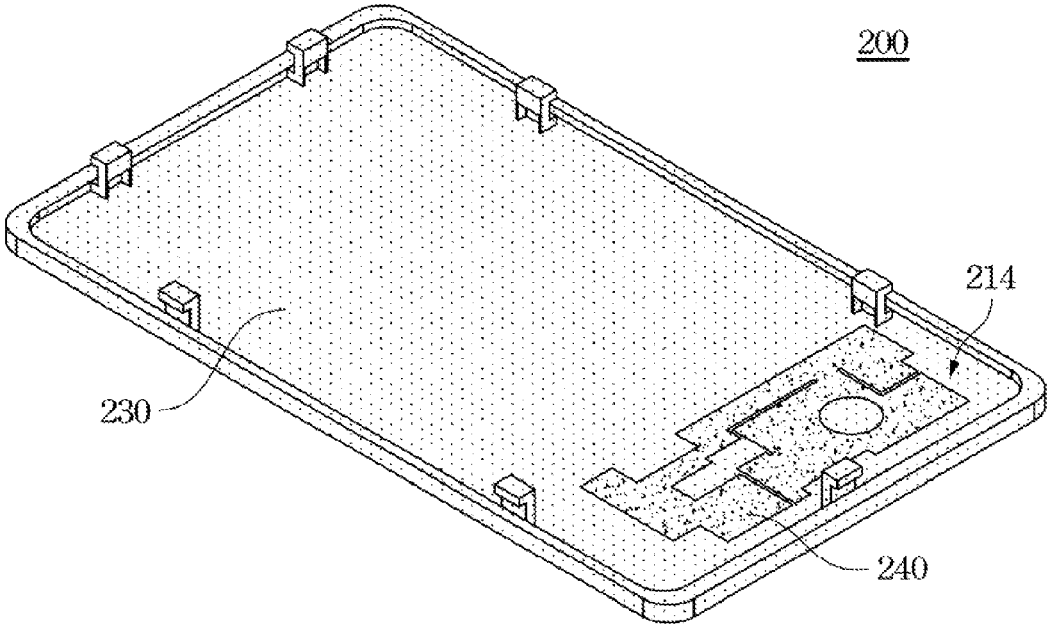

In the method 100, step 105 is to electroplate the antenna region 214 with metal material, so that the metal material can be deposited in the antenna region 214 to form an antenna main body 240 as shown in FIG. 2E. Because the surface 212 of the substrate 210 is electroless plated with a metal medium 220 in step 102, any position of the metal medium 220 on the substrate 210 can serve as a contact to receive an external power voltage during the electroplating process. Thus, the electroplating process can be directly implemented for the substrate 210 with the metal medium 220, so as to facilitate manufacture. After steps 103 and 104 are performed, excluding the antenna region 214, the other region of the surface 212 is covered with a remaining portion of the resist 230. Therefore, the metal material can be deposited on the portion of the metal medium 220 exposed to the antenna region 214 to form the antenna main body 240. In one embodiment, the metal material of the antenna main body 240 is copper, nickel or gold.

Figure 2F:
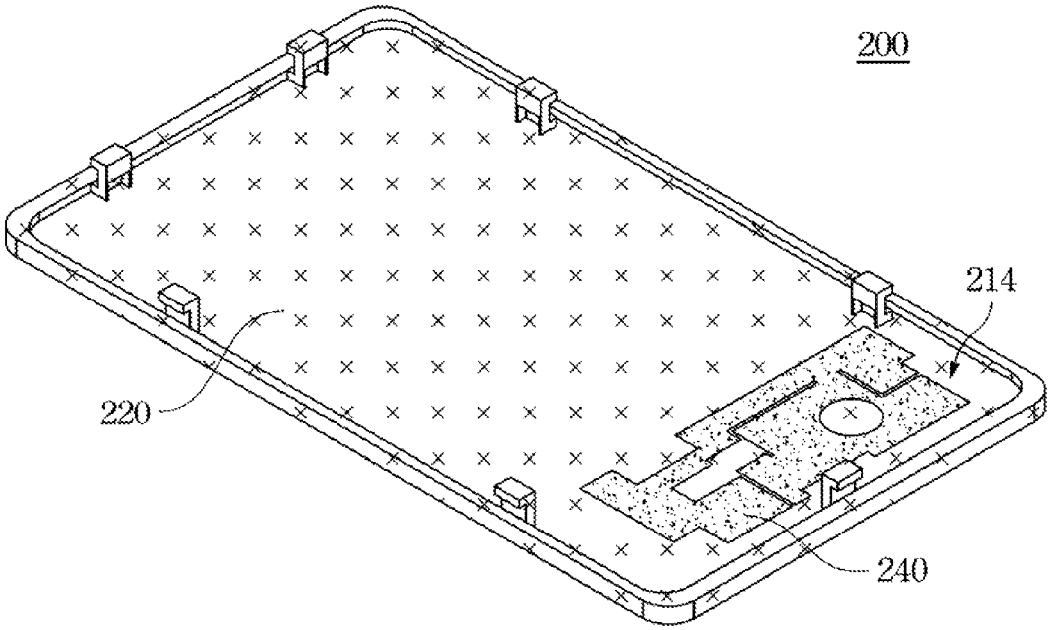

In the method 100, step 106 is to remove the remaining portion of the resist 230, as shown in FIG. 2F. Excluding the antenna main body 240 formed on the antenna region 214, the other region of the surface 212 is covered with the other of the metal medium 220.

Figure 2G:
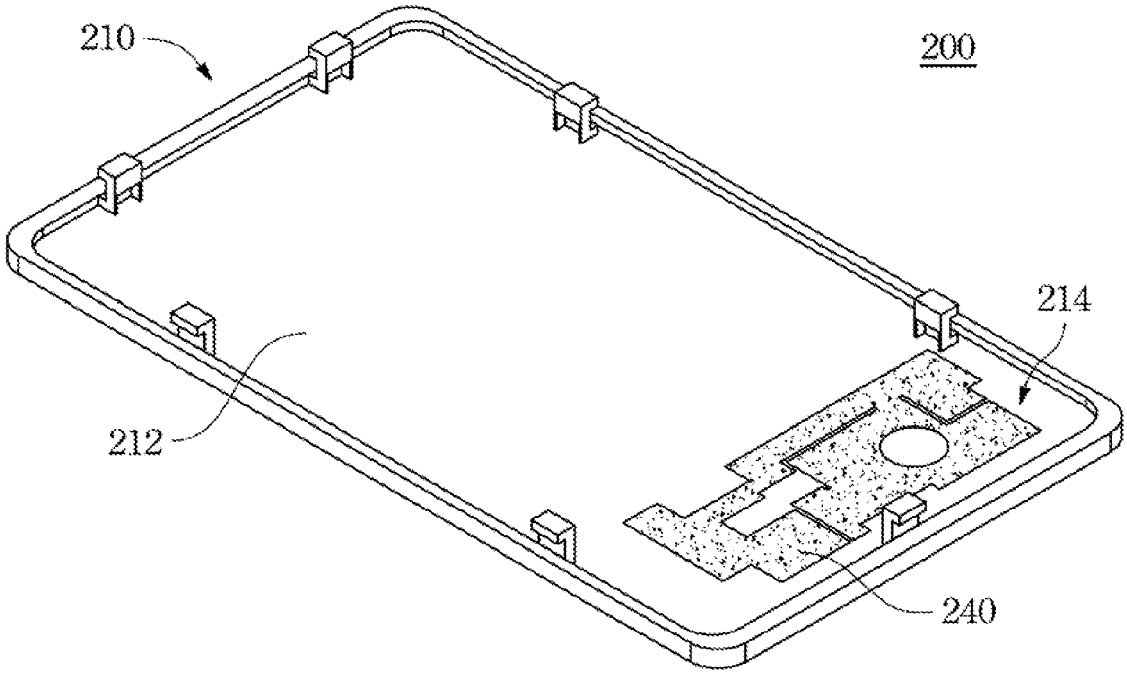

In the method 100, excluding a portion of the metal medium 220 formed in the antenna region 214 (i.e. the antenna main body 240), step 107 is to remove the other portion of the metal medium 220 from the substrate 210, as shown in FIG. 2G. For example, the other portion of the metal medium 220 is etched, so that the antenna main body 240 can be still disposed in the antenna region 214.

The process limitation and other problems are generally reduced, solved or circumvented, and technical advantages are generally achieved, by using both of electroless plating and electroplating. In this way, the antenna can be formed on the housing of the communication product, so that the inner space of the housing can be effectively reduced. In use, the antenna of the present invention can replace the conventional sheet metal antenna, so as to simplify production process and to save assembly time.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims herein is not intended to invoke the provisions of 35 U.S.C. §112, 6th paragraph.

What is claimed is:

1. A method for manufacturing an antenna, the method comprising:

providing a substrate, wherein a surface of the substrate has an antenna region;

electroless plating the surface of the substrate with a metal medium, so that the surface is covered with the metal medium;

covering the metal medium with a resist;

removing a portion of the resist in the antenna region;

electroplating the antenna region with metal material to form an antenna main body;

removing a remaining portion of the resist; and excluding a portion of the metal medium in the antenna region, removing the other portion of the metal medium from the substrate.

2. The method of claim 1, wherein the antenna region has antenna pattern.

3. The method of claim 1, further comprising:

roughening the surface of the substrate.

4. The method of claim 1, further comprising:

forming a recess in the antenna region.

5. The method of claim 1, wherein the material of the metal medium is palladium or polymeric material.

6. The method of claim 1, further comprising:

exposing the portion of the metal medium to the antenna region by removing the portion of the resist in the antenna region.

7. The method of claim 1, wherein the remaining portion of the resist is removed through dry etching.

8. The method of claim 7, wherein the dry etching is laser carving.

9. The method of claim 1, wherein the metal material is copper, nickel or gold.

* * * * *